US007108350B2

(12) United States Patent
Ishihara

(10) Patent No.: US 7,108,350 B2
(45) Date of Patent: Sep. 19, 2006

(54) LIQUID-DISCHARGING APPARATUS

(75) Inventor: Mitsugu Ishihara, Kanagawa (JP)

(73) Assignee: Sony Corporation, Tokyo (JP)

( * ) Notice: Subject to any disclaimer, the term of this patent is extended or adjusted under 35 U.S.C. 154(b) by 286 days.

(21) Appl. No.: 10/870,509

(22) Filed: Jun. 17, 2004

(65) Prior Publication Data

US 2005/0012777 A1 Jan. 20, 2005

(30) Foreign Application Priority Data

Jun. 20, 2003 (JP) ..... P2003-175915

(51) Int. Cl.
*B41J 2/165* (2006.01)

(52) U.S. Cl. ..... 347/29; 347/36; 347/14; 347/23

(58) Field of Classification Search ..... 347/14, 347/19, 22, 23, 29–36
See application file for complete search history.

(56) References Cited

U.S. PATENT DOCUMENTS 6,637,856 B1 * 10/2003 Nishi et al. ..... 347/29

* cited by examiner

*Primary Examiner*—Juanita D. Stephens
(74) *Attorney, Agent, or Firm*—Sonnenschein Nath & Rosenthal LLP

(57) ABSTRACT

In a liquid-discharging apparatus, the work volume of a cleaning roller of a liquid-discharging head and the work volume of a waste-liquid receiver of a head cap are displayed. A dot array or a dot is formed by discharging a predetermined liquid from a plurality of liquid-discharging nozzles provided on a nozzle surface of the liquid-discharging head. The liquid-discharging apparatus includes a roller-wiping-count storage unit for storing the accumulated work volume of the cleaning roller during a period from the beginning of use to the present time, an idle-discharging-count storage unit for storing the accumulated work volume of the waste-liquid receiver during the period, and an information output unit that receives the work volumes from the storage units, and that outputs both of or the higher one of the work volumes.

12 Claims, 11 Drawing Sheets

LIQUID-DISCHARGING APPARATUS

RELATED APPLICATION DATA

The present application claims priority to Japanese Application(s) No(s). P2003-175915 filed Jun. 20, 2003, which application(s) is/are incorporated herein by reference to the extent permitted by law.

BACKGROUND OF THE INVENTION

1. Field of the Invention

The present invention relates to a liquid-discharging apparatus that forms dot arrays or dots by discharging a predetermined liquid from liquid-discharging nozzles provided in a liquid-discharging head.

2. Description of the Related Art

In known serial-head ink-jet printers, a print head having a size shorter than the print width of recording paper performs printing while moving from side to side. In this case, in order to prevent printing failure due to clogging of ink-discharging nozzles, idle discharging of ink is performed in a state in which the print head is positioned at a waste-ink receiver provided outwardly separate from the recording paper, and nozzle cleaning is performed by absorbing ink in a state in which the print head is positioned at an ink-absorbing mechanism provided in a head cap outwardly separate from the recording paper.

It is relatively easy to do nozzle cleaning in the serial-head ink-jet printers in which printing is performed by the print head that is reciprocally moving from side to side. Even when idle discharging into the waste-ink receiver is performed, the amount of discharged ink is small and the ink naturally dries because the print head has a small number of nozzles. Accordingly, the user does not need to replace the waste-ink receiver at appropriate intervals of use.

In recent years, full-line print heads have been provided which extend long along the width of one side of a recording sheet (e.g., A4-size sheet). In such full-line print heads, arrays of ink-discharging nozzles are arranged in a length substantially equal to the print width of the recording sheet. Therefore, when idle discharging into the waste-ink receiver is performed in order to prevent print failure due to the clogging of the ink-discharging nozzles, the amount of discharged ink is larger than that in the serial heads, and the user sometimes needs to replace the waste-ink receiver at appropriate intervals of use.

In this case, it is necessary to inform the user as to the timing of replacement of the waste-ink receiver. A technique of giving such information is proposed in, for example, Japanese Patent No. 2755791 (page 1, FIG. 5). In this publication, the accumulated number of operations of forcibly discharging a predetermined amount of ink from the ink-discharging nozzles during a discharging recovery process is counted and stored beforehand, and it is determined whether the waste-ink receiver can receive more ink before a new discharging recovery process is performed. When it is determined that the waste-ink receiver cannot receive more ink, a warning to replace the waste-ink receiver is given.

In the technique disclosed in the above publication, the number of ink discharging operations in every discharging recovery process is counted, the accumulated number is stored, and it is determined whether the waste-ink receiver can receive ink discharged in the next recovery process, on the basis of the stored accumulated number. However, this technique is not applicable to a print head which also includes a cleaning member that wipes (absorbs) ink while moving on the nozzle surface, and in which the amount of ink absorbed by the cleaning member is detected, and the timing of replacement of the cleaning member is determined by the accumulated amount of absorbed ink. Therefore, in a print head having both a waste-ink receiver and a cleaning member, it is sometimes impossible to properly determine the timings of replacement of the discharged-receiver and the cleaning member during the use.

SUMMARY OF THE INVENTION

In order to overcome the above problems, an object of the present invention is to provide a liquid-discharging apparatus that can display the work volume of a cleaning member in a liquid-discharging head and the work volume of a waste-liquid receiver provided in a head cap.

In order to achieve the above object, according to one aspect, the present invention provides a liquid-discharging apparatus in which the accumulated work volume of a cleaning member for wiping a nozzle surface of a liquid-discharging head during a period from the beginning of an operation to the present time is stored, the accumulated work volume of a waste-liquid receiver provided in a head cap for protecting the nozzle surface during the period is stored, and an information output unit receives the stored work volumes and outputs both of or the larger one of the volumes. Consequently, the work volume of the cleaning member and the work volume of the waste-liquid receiver can be displayed.

Therefore, in the liquid-discharging head with a head cap having a cleaning member and a waste-liquid receiver, it is possible to properly determine the timing of replacement of the head cap during the use.

The accumulated work volume of a cleaning member for wiping a nozzle surface of a liquid-discharging head during a period from the beginning of an operation to the current time is stored, the accumulated work volume of a waste-liquid receiver provided in a head cap for protecting the nozzle surface during the period is stored, and a display unit receives the stored work volumes and outputs both of or the larger one of the work volumes. Consequently, the work volume of the cleaning member and the work volume of the waste-liquid receiver can be displayed.

Therefore, in the liquid-discharging head with a head cap having a cleaning member and a waste-liquid receiver, it is possible to properly determine the timing of replacement of the head cap during use.

Preferably, the liquid-discharging apparatus further includes a control unit that receives the work volumes from two accumulated-volume storage unit, and stops a subsequent liquid-discharging operation when one of the work volumes exceeds a predetermined upper limit. Accordingly, it is possible to automatically stop the liquid-discharging operation, and prevent the quality of dot arrays or dots formed by the liquid-discharging nozzles from being reduced by the excess of the work volume over the predetermined upper limit.

Preferably, an output signal from the information output unit is sent to a display unit for displaying the driving states of units provided in a main assembly of the apparatus. This allows the user to view the content concerning the work volumes displayed on the display unit, and to properly determine the timing of replacement of the head cap.

Preferably, an output signal from the information output unit is sent to a display unit for displaying the content of information processing of an information processing apparatus connected to a main assembly of the apparatus. This allows the user to view the content concerning the work volumes displayed on the display unit of the information processing apparatus, and to properly determine the timing of replacement of the head cap.

Preferably, the output signal from the information output unit includes a signal for displaying the work volumes from the accumulated-volume storage unit in the form of a numeral, a graph, or an image. In this case, the user can easily view the displayed work volumes.

Further objects, feature, and advantages of the present invention will become apparent from the following description of the preferred embodiments with reference to the attached drawings.

DESCRIPTION OF THE PREFERRED EMBODIMENTS

An embodiment of the present invention will be described in detail below with reference to the attached drawings.

Figure 1:
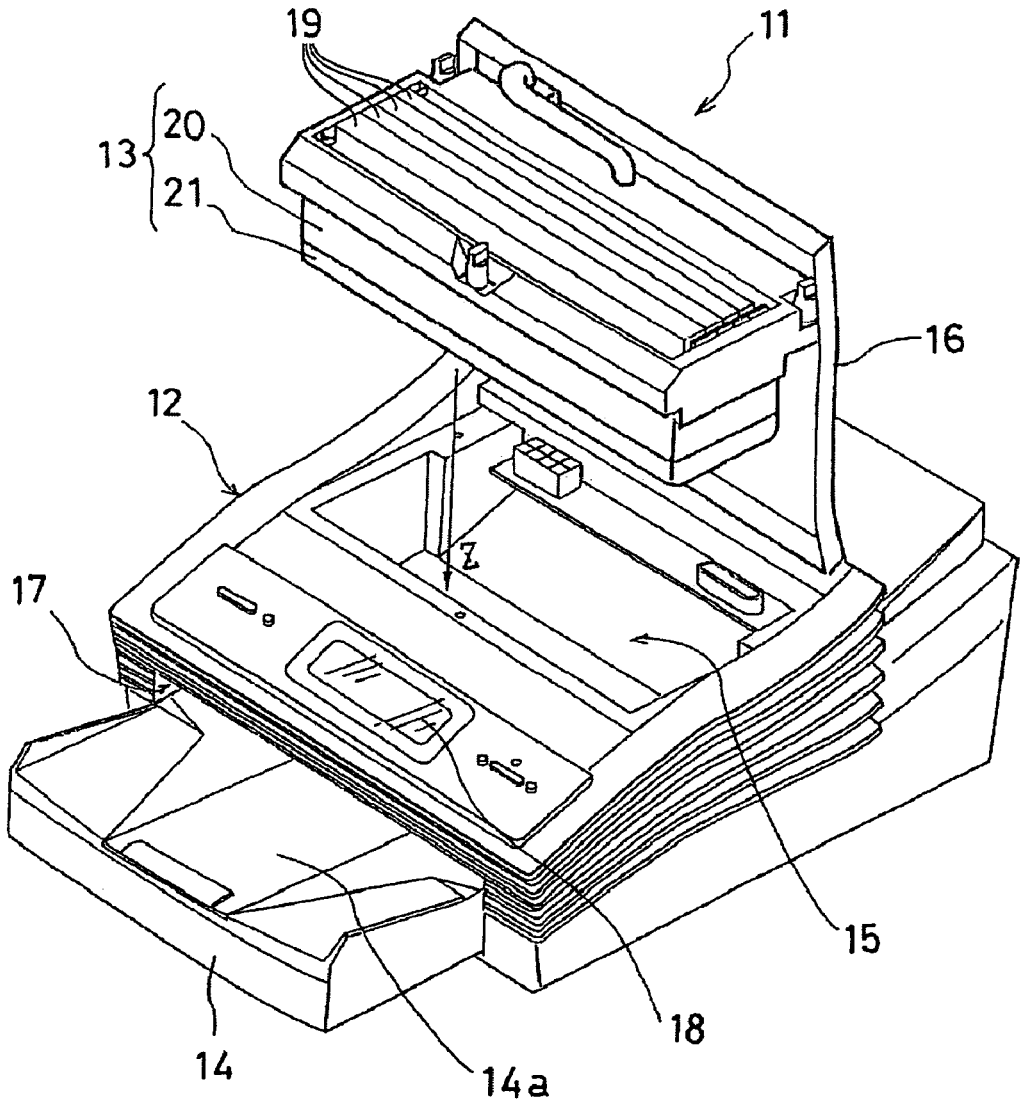
FIG. 1 is a perspective view of an ink-jet printer serving as a liquid-discharging apparatus according to an embodiment of the present invention.

FIG. 1 is a perspective view of an ink-jet printer serving as a liquid-discharging apparatus according to an embodiment of the present invention. An ink-jet printer 11 forms an image by discharging ink droplets onto required positions on a recording medium, and includes a main assembly 12, a head cartridge 13, and a recording-sheet tray 14.

A recording-sheet feeding mechanism and an electric circuit section for performing proper printing on a recording sheet serving as a recording medium are provided inside the main assembly 12. A storage section 15 for accommodating the head cartridge 13 is open at the top of the main assembly 12, and an upper cover 16 is provided at the top end of the storage section 15 to open and close the storage section 15. A tray insertion slot 17 in which a recording-sheet tray 14, which will be described later, is mounted is provided at the lower front of the main assembly 12. The tray insertion slot 17 also serves as an ejection port for recording sheets. A display panel (display unit) 18 for displaying the operating states of the entire ink-jet printer 11 is provided at the upper front of the main assembly 12.

The head cartridge 13 is put in the storage section 15 of the main assembly 12 in the direction shown by arrow Z, and is detachably held therein. The head cartridge 13 includes a print head 20 having ink tanks 19 for four colors, yellow Y, magenta M, cyan C, and black K, and a head cap 21 attached to the lower side of the print head 20. In this embodiment, the print head 20 is of a full-line type in which nozzle members extend along one side of a recording sheet (e.g., an A4-size sheet).

The recording-sheet tray 14 is detachably mounted in the tray insertion slot 17 of the main assembly 12. The recording-sheet tray 14 accommodates stacked recording sheets, and has, on its upper surface, an ejected-sheet receiver 14*a* for receiving recording sheets ejected from the main assembly 12.

Figure 2:
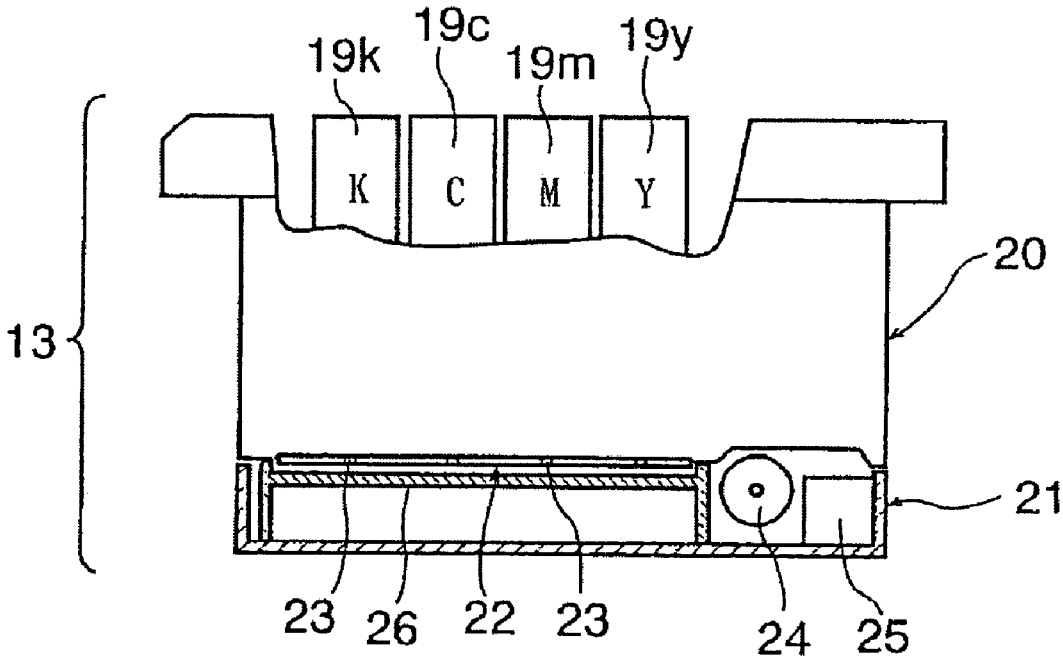
FIG. 2 is a partly sectional side view showing the structure of a head cartridge provided in the ink-jet printer.

FIG. 2 is a partly sectional side view showing the structure of the head cartridge 13. The ink tanks 19 serve as reservoirs for storing predetermined liquids (inks), and include four tanks 19*y*, 19*m*, 19*c*, and 19*k* detachably mounted corresponding to inks of four colors Y, M, C, and K. The print head 20 serves as a liquid-discharging head for discharging ink supplied from the ink tanks 19*y*, 19*m*, 19*c*, and 19*k*. Arrays of ink-discharging nozzles (liquid-discharging nozzles) 23 for four colors Y, M, C, and K are provided on a nozzle surface 22 at the bottom.

The head cap 21 is detachably mounted on the lower side of the print head 20 so as to move relative to the print head 20. The head cap 21 protects the nozzle surface 22 of the print head 20. The head cap 21 is shaped like, for example, an elongated box having standing edges on its periphery, and includes therein a cleaning roller (cleaning member) 24 for wiping a thickened and adhering ink residue while moving on the nozzle surface 22, and a waste-ink receiver 25 for receiving ink idly discharged from the ink-discharging nozzles 23.

The cleaning roller 24 is made of an elastic and hygroscopic material, for example, sponge. The waste-ink receiver 25 is made of a hygroscopic material, for example, sponge. A nozzle-sealing member 26 is provided inside the head cap 21 adjacent to the nozzle surface 22 of the print head 20.

Figure 3:
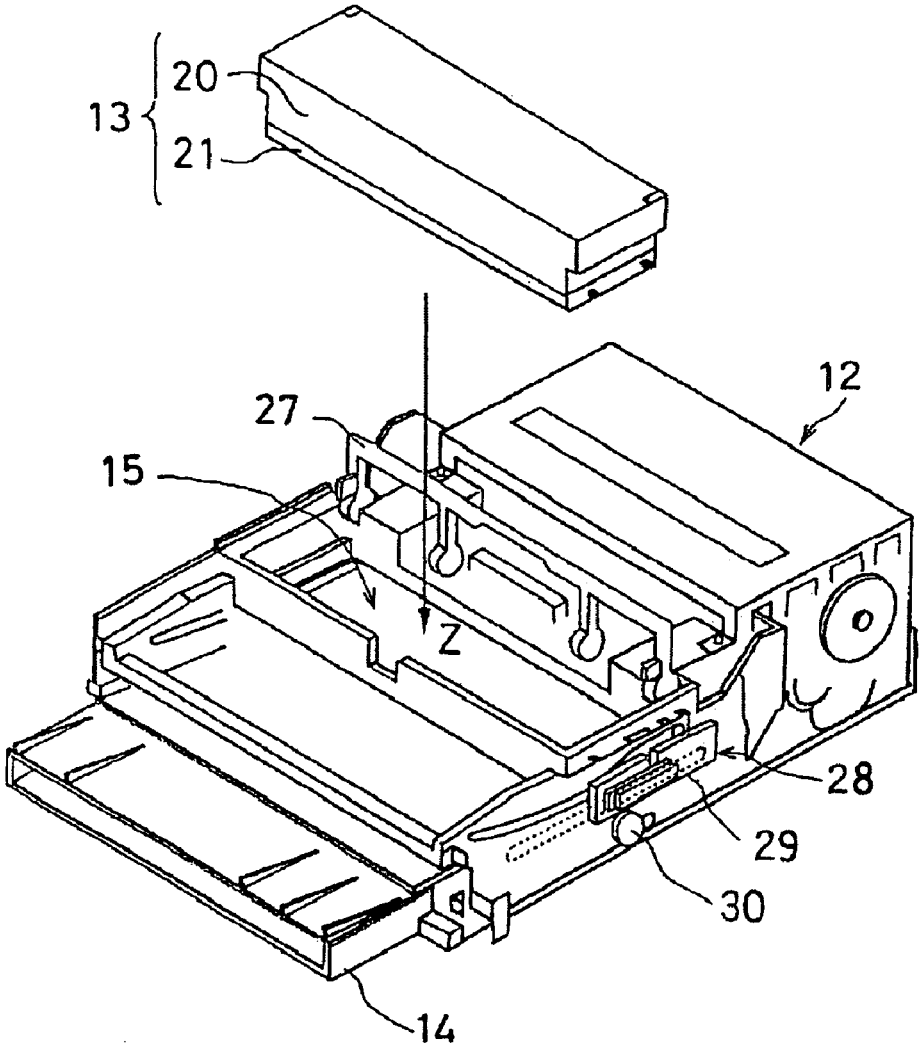
FIG. 3 is an explanatory view showing the internal configuration of a main assembly of the ink-jet printer shown in FIG. 1 from which an outer cover is removed.

A structure for moving the head cap 21 will now be described with reference to FIGS. 3 and 4. FIG. 3 is an explanatory view showing the internal configuration of the main assembly 12 from which an outer cover is removed, and FIG. 4 is an explanatory view of a head-cap opening and closing mechanism.

Referring to FIG. 3, after the head cartridge 13 is moved down in the direction of arrow Z and is put in the storage section 15 of the main assembly 12, it is fixed to the main assembly 12 by tilting a head-release mechanism 27 forward approximately 90°. In this case, the head cap 21 shown in FIG. 2 engages with a head-cap opening and closing mechanism 28 shown in FIG. 3.

Figure 4:
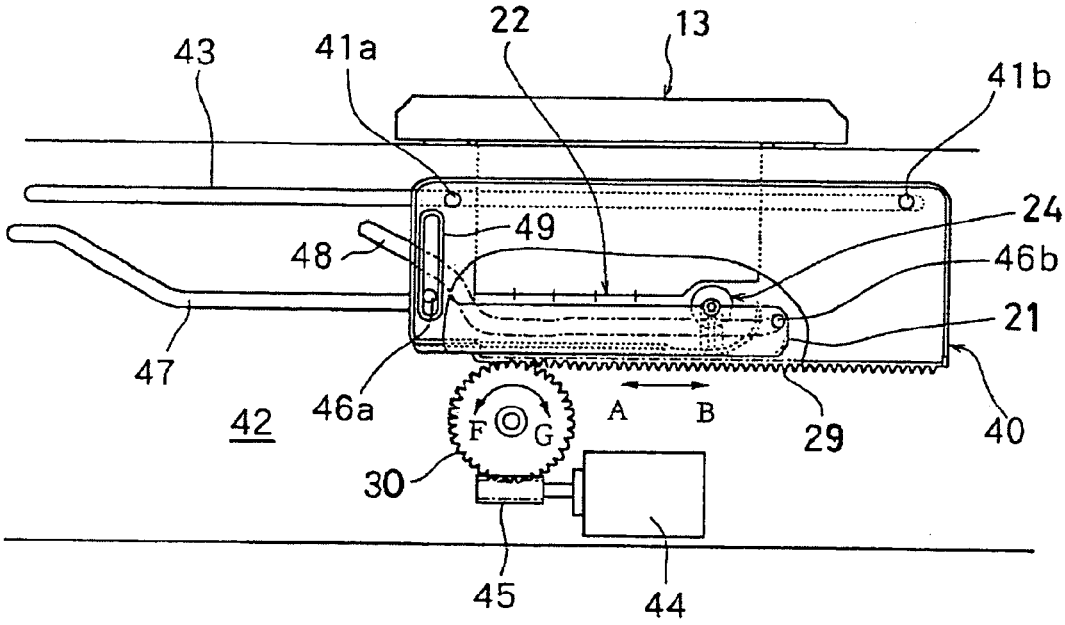
FIG. 4 is an explanatory view of a head-cap opening and closing mechanism shown in FIG. 3.

FIG. 4 is a side view showing the details of the head-cap opening and closing mechanism 28. First, the head cap 21 having the cleaning roller 24 shown in FIG. 2 is supported in connection with a moving rack plate 40 having a linear rack 29 at the lower edge thereof, as shown in FIG. 4.

The moving rack plate 40 allows the head cap 21 to move in the directions shown by arrows A and B, and is supported in a state in which two guide pins 41*a* and 41*b* provided at both upper ends of an inner side face thereof are engaged with a linear guide groove 43 provided in one outer side plate 42 of the main assembly 12 shown in FIG. 3 and in which the rack 29 at the lower edge is meshed with a pinion 30 to be rotated by a worm gear 45 on a rotation shaft of a moving motor 44 provided on the outer side plate 42.

Two front and rear cap guide pins 46*a* and 46*b* protrude from one outer side face of the head cap 21 toward the moving rack plate 40.

Two cap guide grooves 47 and 48 curved in given shapes are provided in the center of the outer side plate 42 of the main assembly 12 to define a moving path of the head cap 21.

The front and rear cap guide pins 46*a* and 46*b* of the head cap 21 are engaged, respectively, with the cap guide grooves 47 and 48 of the outer side plate 42 of the main assembly 12, and only the front cap guide pin 46*a* is also engaged with a guide groove 48 vertically provided in the front end of the moving rack plate 40.

In such a mechanism, the pinion 30 is rotated by the moving motor 44 through the worm gear 45 in the directions shown by arrows F and G, and the moving rack plate 40 is moved by the rack 29 meshed with the pinion 30 in the directions shown by arrows A and B.

In this case, since the front cap guide pin 46*a* of the head cap 21 is engaged with the guide groove 49 at the front end of the moving rack plate 40, the head cap 21 moves together with the moving rack plate 20 in the directions shown by arrows A and B. The moving path of the head cap 21 is determined by the shapes of the cap guide grooves 47 and 48 with which the two cap guide pins 46*a* and 46*b* are engaged.

A description will be given of a cleaning operation performed when the head cap 21 is moved by the head-cap opening and closing mechanism 28 having the above-described structure, with reference to FIGS. 5A to 5E.

Figure 5A:
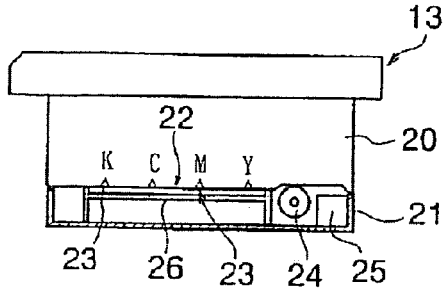
FIGS. 5A to 5E are explanatory views showing a cleaning operation performed when a head cap is moved by the head-cap opening and closing mechanism.

In an initial state shown in FIG. 5A, the head cap 21 is closed, and covers the nozzle surface 22 of the print head 20, and the ink-discharging nozzles 23 for four colors Y, M, C, and K on the nozzle surface 22 are protected by the nozzle-sealing member 26.

Figure 5B:
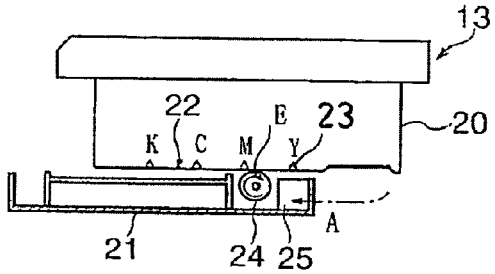

When a cap-opening trigger signal is input to the main assembly 12 in this state, for example, when the printer is powered on, when a printing operation is started, or when a command from the user is input, the moving motor 44 shown in FIG. 4 is rotated, and the head cap 21 starts to move in the direction shown by arrow A, as shown in FIG. 5B.

In this case, with the movement of the head cap 21, the cleaning roller 24, made of, for example, sponge sequentially rolls while rubbing the nozzle surface 22. During the rolling motion, the cleaning roller 24 wipes a solidified and thickened ink residue off the Y, M, C, and K ink-discharging nozzles 23.

When an optical or mechanical sensor detects that the waste-ink receiver 25 made of, for example, sponge reaches just below ink-discharging nozzles 23 from which the ink residue has been wiped by the cleaning roller 24, idle discharging is performed to prevent the ink-discharging nozzles 23 from clogging.

FIG. 5B shows a state in which idle discharging of ink to the waste-ink receiver 25 placed just below Y-color ink-discharging nozzle 23 is being performed after a Y-color ink residue is wiped from the ink-discharging nozzles 23 by the cleaning roller 24.

Figure 5C:
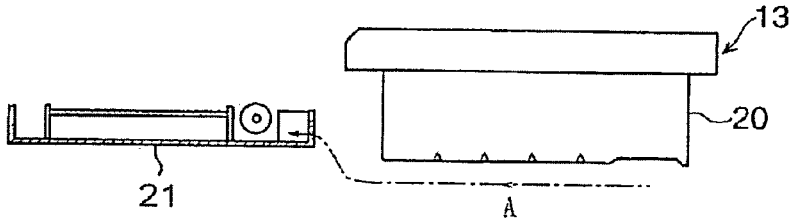

When such operations of wiping by the cleaning roller 24 and of idle discharging are completed for all the Y, M, C, and K ink-discharging nozzles 23, the head cap 21 is fully moved in the direction shown by arrow A and is placed at a head-cap standby position, as shown in FIG. 5C. In this state, the main assembly 12 and the head cartridge 13 are ready for printing.

Figure 5D:
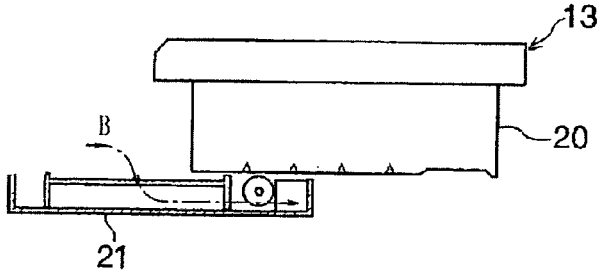
Figure 5E:
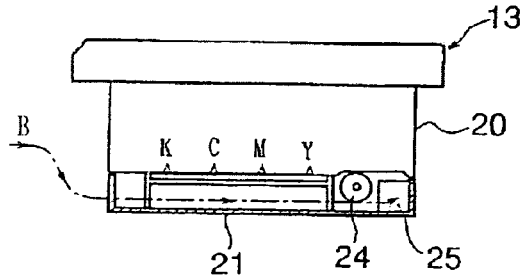

When a printing operation is completed, a cap-closing trigger signal is input to the main assembly 12, the moving motor 44 shown in FIG. 4 is rotated in reverse, and the head cap 21 moves from the head-cap standby position in the direction shown by arrow B and returns to the original position along the same path as before, as shown in FIG. 5D.

In the return movement, the cleaning roller 24 does not wipe the ink-discharging nozzles 23, and idle discharging is not performed. This is because the life of the cleaning roller 24 is extended to delay the exchange timing.

The head cap 21 is fully moved in the direction B, as shown in FIG. 5E, and is brought again into the initial state shown in FIG. 5A.

Figure 6:
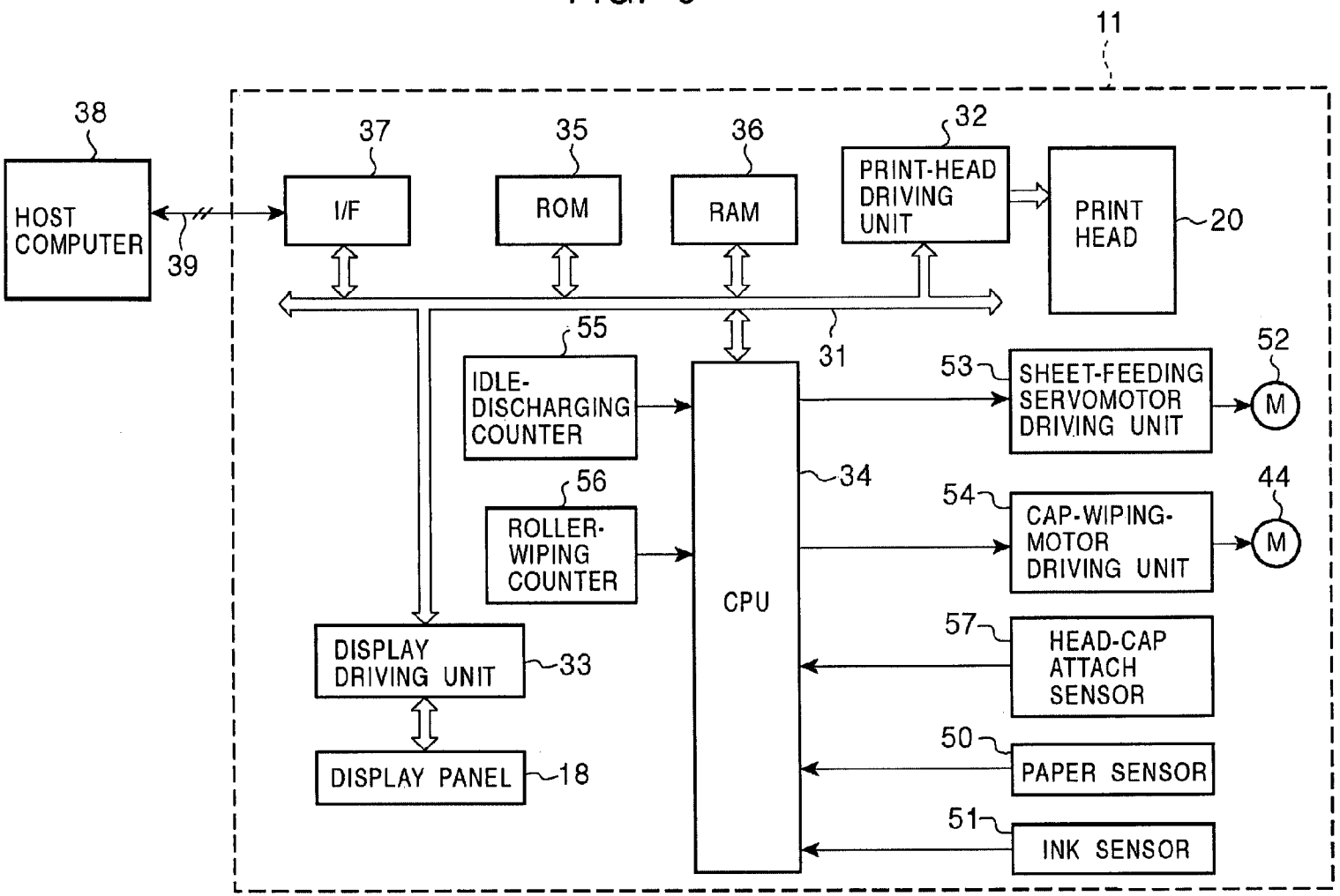
FIG. 6 is a block diagram showing the internal configuration of the ink-jet printer shown in FIG. 1.

FIG. 6 is a block diagram showing the internal configuration of the ink-jet printer 11 shown in FIG. 1. Referring to FIG. 6, a system bus 31 for transferring information inside the ink-jet printer 11 is connected to a print-head driving unit 32 for driving the print head 20, a display driving unit 33 for driving the display panel 18, and a CPU (central processing unit) 34 for controlling the operations of the components inside the ink-jet printer 11.

A ROM 35 serving as a main memory that stores a program for driving the ink-jet printer 11, and a RAM 36 that reads and writes various data are also connected to the system bus 31. The ink-jet printer 11 is connected to a host computer 38 serving as an information processing apparatus through an interface 37 connected to the system bus 31. Reference numeral 39 denotes a communication line or a connecting cable.

The CPU 34 is connected to a paper sensor 50 for detecting whether recording sheets are stacked in the recording-sheet tray 14 mounted in the tray insertion slot 17 shown in FIG. 1, and to an ink sensor 51 for detecting whether ink is stored in the ink tanks 19 provided in the print head 20.

The CPU 34 is also connected to a sheet-feeding servomotor driving unit 53 (including a sheet-feeding servo circuit) that sends a driving signal to a sheet-feeding servomotor 52, and to a cap-wiping-motor driving unit 54 that sends a driving signal to the moving motor 44 for reciprocally moving the head cap 21 and the cleaning roller 24 shown in FIG. 4.

The CPU 34 is also connected to an idle-discharging counter 55 for counting the number of operations of idly discharging ink from the ink-discharging nozzles 23 shown in FIG. 5B, and a roller-wiping counter 56 for counting the number of wiping operations by the cleaning roller 24 for the nozzle surface 22.

A head-cap attach sensor 57 detects the detachment and attachment, that is, the exchange of the head cap 21 in accordance with the period of use of the ink-jet printer 11.

Figure 7:
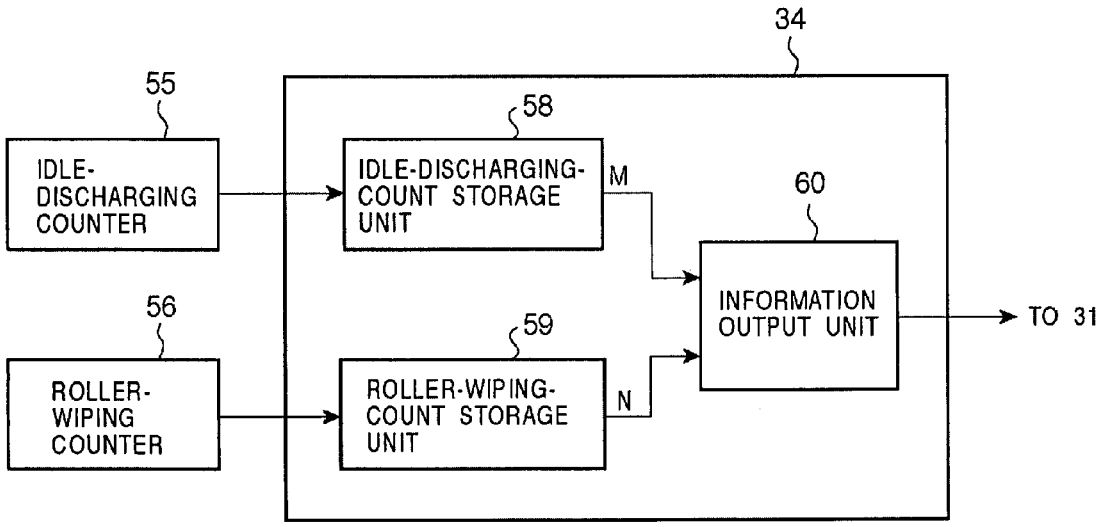
FIG. 7 is a block diagram showing an example of an internal configuration of a CPU provided in the ink-jet printer.

In the present invention, the CPU 34 includes an idle-discharging-count storage unit 58, a roller-wiping-count storage unit 59, and an information output unit 60, as shown in FIG. 7.

The idle-discharging-count storage unit 58 serves as a means for storing the accumulated work volume of the waste-ink receiver 25 of the head cap 21 between the beginning of use of the ink-jet printer 11 and the present time. The idle-discharging-count storage unit 58 receives and stores a signal corresponding to the number of operations of idle-discharging from the ink-discharging nozzles 23 counted by the idle-discharging counter 55, and outputs a signal corresponding to the total count M.

The roller-wiping-count storage unit 59 similarly serves as a means for storing the accumulated work volume of the cleaning roller 24 between the beginning of use of the ink-jet printer 11 and the present time. The roller-wiping-count storage unit 59 receives and stores a signal corresponding to the number of operations of wiping the nozzle surface 22 by the cleaning roller 24 counted by the roller-wiping counter 56, and outputs a signal corresponding to the total count N.

The information output unit 60 serves as an information output means that receives the number M of idle-discharging operations (work volume) and the number N of wiping operations of the cleaning roller 24 (work volume) from the idle-discharging-count storage unit 58 and the roller-wiping-count storage unit 59, respectively, and that outputs both of or the larger one of the numbers M and N.

When the larger one of the numbers M and N is output, the information output unit 60 includes a comparator circuit that compares the numbers M and N and selects the larger one.

A signal output from the information output unit 60 is sent to the display panel 18, which displays the driving states of the devices provided in the ink-jet printer 11, through the system bus 31 shown in FIG. 6, and is displayed thereon. Alternatively, the signal is sent to a display device for displaying information processed in the host computer 38 connected to the ink-jet printer 11, and is displayed on a screen of the display device.

The display content, that is, the number M of idle-discharging operations and the number N of wiping operations are displayed, for example, by numerical values, in graphs (bar graphs or circle graphs), or in figures (e.g., figures of the waste-ink receiver 25 and the cleaning rollers 24).

The signal output from the information output unit 60 may be displayed on both of or one of the display panel 18 of the ink-jet printer 11 and the display device of the host computer 38 serving as the external apparatus.

Figure 8:
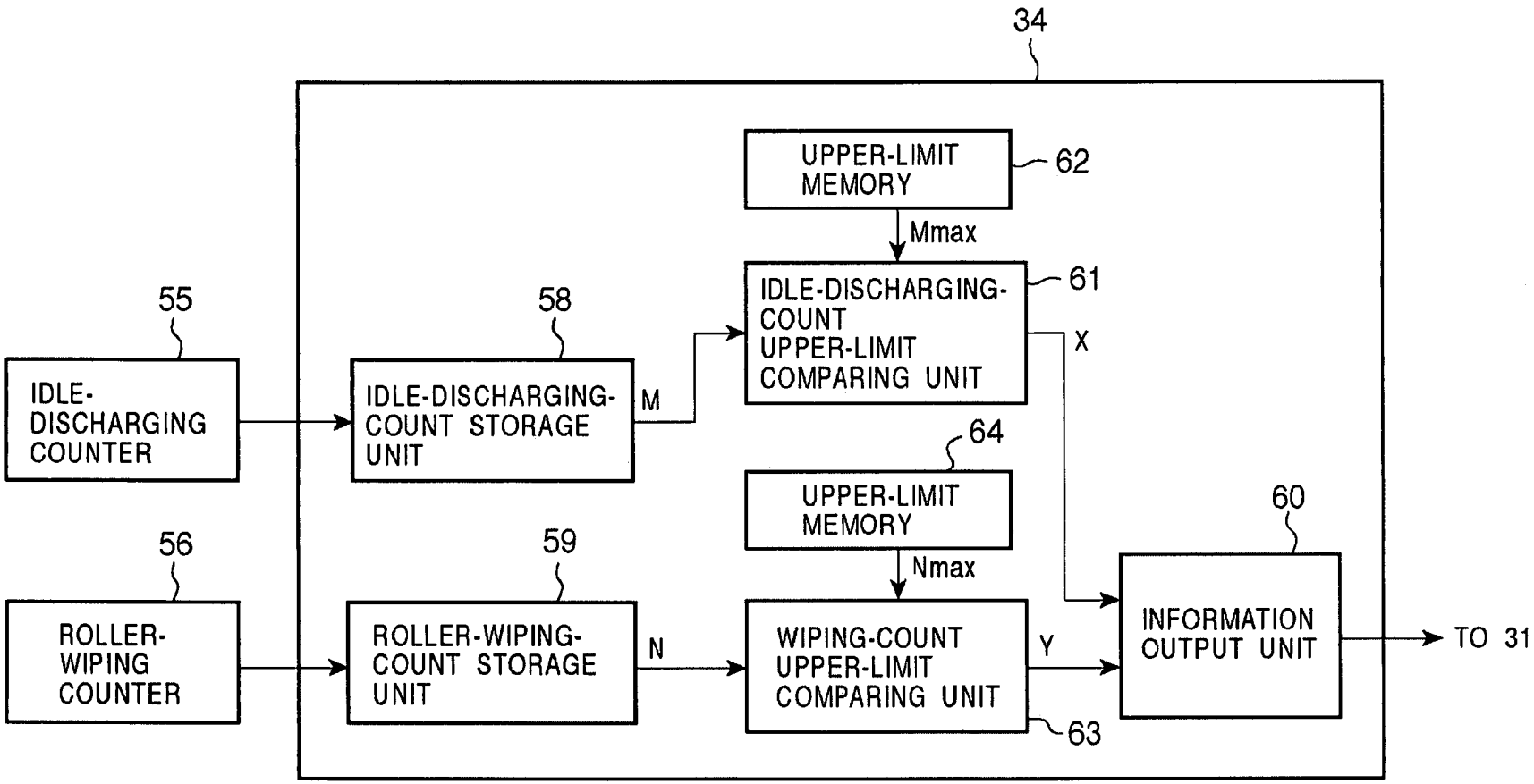
FIG. 8 is a block diagram showing another example of an internal configuration of the CPU.

FIG. 8 is a block diagram showing another example of an internal configuration of the CPU 34. In this example, an idle-discharging-count upper-limit comparing unit 61 is provided on the downstream side of the idle-discharging-count storage unit 58, and a wiping-count upper-limit comparing unit 63 is provided on the downstream side of the roller-wiping-count storage unit 59.

The idle-discharging-count upper-limit comparing unit 61, such as a comparator, serves as an upper-limit comparing means that receives the number M of idle discharging operations from the idle-discharging-count storage unit 58 and that compares the number M with a predetermined upper limit number Mmax of idle discharging operations to the waste-ink receiver 25. The idle-discharging-count upper-limit comparing unit 61 reads the upper limit number Mmax stored in an upper-limit memory 62, compares the number Mmax with the number M, and outputs a comparison-result signal X when a value obtained by the comparison exceeds a predetermined value.

In this case, the number M and the upper limit number Mmax are compared by detecting whether M is larger than Mmax, or obtaining the difference between M and Mmax, or the ratio between M and Mmax. A comparison-result signal X may be output when M is larger than or equal to Mmax, when the difference between M and Mmax exceeds a predetermined value, or when the ratio between M and Mmax exceeds a predetermined value. Alternatively, a comparison-result signal X may be output when the difference between M and Mmax is 0 or when the ratio therebetween is 1.

The wiping-count upper-limit comparing unit 63, such as a comparator, serves as an upper-limit comparing means that receives the number N of wiping operations of the cleaning roller 24 from the roller-wiping-count storage unit 59 and that compares the number N with a predetermined upper limit number Nmax of wiping operations. The wiping-count upper-limit comparing unit 63 reads the upper limit number Nmax stored in an upper-limit memory 64, compares the number Nmax with the number M, and outputs a comparison-result signal Y when a value obtained by the comparison exceeds a predetermined value.

In this case, the number N and the upper limit number Nmax are compared by detecting whether N is larger than Nmax, or obtaining the difference between N and Nmax, or the ratio between N and Nmax. A comparison-result signal Y may be output when N is larger than or equal to Nmax, when the difference between N and Nmax exceeds a predetermined value, or when the ratio between N and Nmax exceeds a predetermined value. Alternatively, a comparison-result signal Y may be output when the difference between N and Nmax is 0 or when the ratio therebetween is 1.

An information output unit 60 receives the comparison-result signals X and Y from the idle-discharging-count upper-limit comparing unit 61 and the wiping-count upper-limit comparing unit 63, and outputs a signal concerning the number M of idle-discharging operations (work volume of the waste-liquid receiver 25) and the number N of wiping operations (work volume of the cleaning roller 24).

While the work volume of the cleaning roller 24 refers to the number N of wiping operations of the cleaning roller 24 for the nozzle surface 22 in the above description, it is not limited thereto. For example, the work volume may be the amount of ink absorbed by the cleaning roller 24 that is calculated from the number N of wiping operations. In this case, an amount P of ink absorbed by the cleaning roller 24 during one wiping operation is obtained beforehand by experiments or by other means, and an amount Q of ink absorbed by the cleaning roller 24 during a certain period of use is given by the following expression:

$$Q=N\cdot P$$

Alternatively, the work volume of the cleaning roller 24 may be an amount Q of absorbed ink that is calculated by a predetermined equation (Q=F(N)) from the above-described number N of wiping operations. The function expression is obtained by experiments or by other means.

While the work volume of the waste-ink receiver 25 in the head cap 21 refers to the number M of idle-discharging operations in the above description, it is not limited thereto. For example, the work volume may be the amount of ink absorbed by the waste-ink receiver 25 that is calculated on the basis of the number M of idle-discharging operations. In this case, a volume L of ink discharged during one idle discharging operation is obtained beforehand by experiments or by other means, and an amount R of ink absorbed by the waste-ink receiver 25 during a certain period of use is given by the following expression:

$$R=M\cdot L$$

Alternatively, the work volume of the waste-ink receiver 25 may be an amount R of absorbed ink that is calculated by a predetermined equation (R=F(M)) from the above-described number M of idle-discharging operations. The function expression is obtained by experiments or by other means.

A description will now be given of a procedure for displaying the work volume of the cleaning roller 24 and the work volume of the waste-ink receiver 25 during a cleaning operation in the ink-jet printer 11, with reference to FIG. 9 as a flowchart.

First, the nozzle surface 22 of the print head 20 is cleaned when the printer is powered on, before a printing operation is started, or in response to a request from the user. In this case, at the power-on of the printer or before a printing operation, wiping for the nozzle surface 22 by the cleaning roller 24 and idle discharging are simultaneously performed. In contrast, when the user gives a request, wiping is performed alone or together with idle discharging.

When a command signal to clean the nozzle surface 22 shown in FIG. 2 is input to the main assembly 12, first, the number N of wiping operations by the cleaning roller 24 during a period between the beginning of use of the ink-jet printer 11 and the present time is read from the roller-wiping-count storage unit 59, and the number M of idle-discharging operations during the same period is read from the idle-discharging-count storage unit 58 (Step S1).

Signals corresponding to the number N and the number M thus read are input to the information output unit 60 shown in FIG. 7, and both of or the largest one of the values is sent to the display panel 18 in the ink-jet printer 11 shown in FIG. 6, or to the display device of the host computer 38 connected to the ink-jet printer 11.

Then, the number N of wiping operations and the number M of idle-discharging operations are displayed on the screen of the display panel 18 or on the screen of the display device of the host computer 38 (Step S2). In this case, both of or the higher one of the numbers N and M may be displayed.

Figure 10:
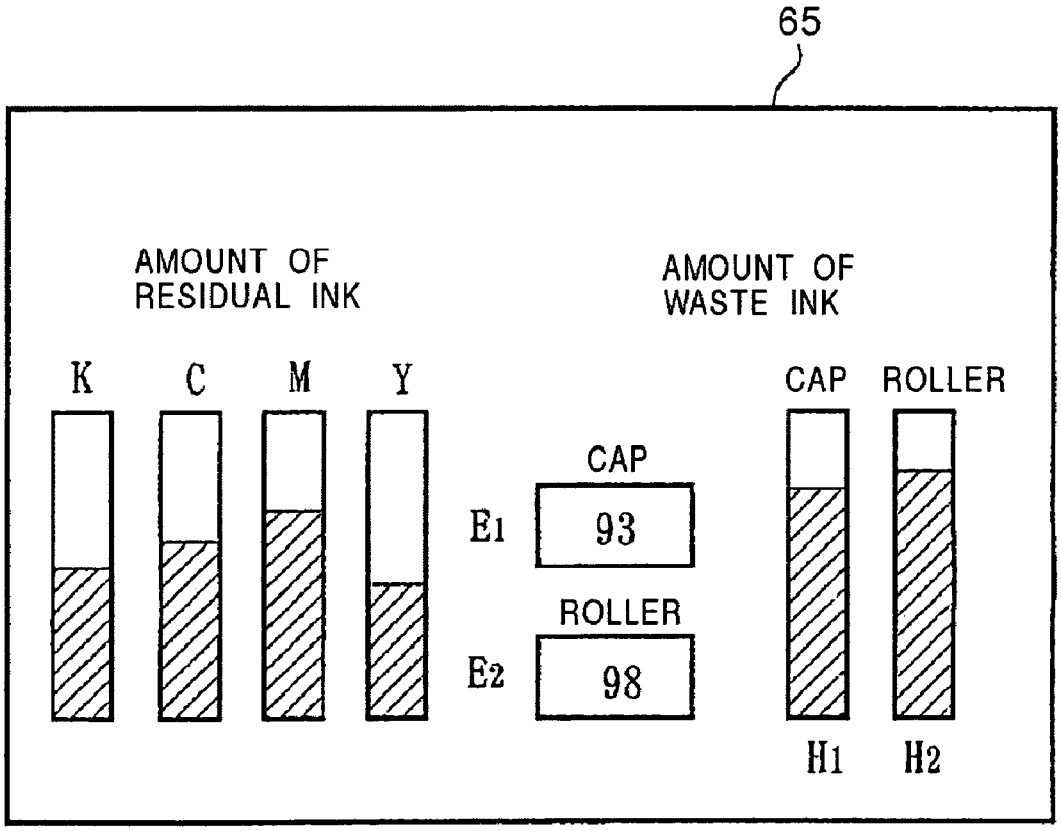
FIG. 10 is an explanatory view showing a state in which a signal output from an information output unit shown in FIG. 7 is sent to a display unit of an information processing apparatus to which the ink-jet printer is connected, and is displayed in a dialog box on a display screen.

FIG. 10 is an explanatory view showing display content. For example, an index E1 (e.g., a numerical value 93) indicating the number M of idle-discharging operations of the waste-ink receiver 25 of the head cap 21, and an index E2 (e.g., a numerical value 98) indicating the number N of wiping operations of the cleaning roller 24 are displayed in a dialog box 65 on the screen of the display device of the host computer 38. In this case, the upper limit of the number M and the upper limit of the number N may be displayed together.

Besides or instead of the indices E1 and E2, a bar graph H1 corresponding to the number M of idle-discharging operations and a bar graph H2 corresponding to the number N of wiping operations may be displayed. Alternatively, the numbers may be displayed in circle graphs or in figures (e.g., in figures of the waste-ink receiver 25 and the cleaning roller 24).

The user views the content displayed on the screen of the display panel 18 or on the screen of the display device of the host computer 38, and determines whether or not to perform a cleaning operation for the nozzle surface 22 by the print head 20. As necessary, a cleaning operation for the nozzle surface 22 is performed.

In this case, the count values in the idle-discharging counter 55 and the wiping counter 56 shown in FIG. 7 are incremented. The incremented numbers M and N are stored in the idle-discharging-count storage unit 58 and the wiping-count storage unit 59.

Furthermore, the head cap 21 and the cleaning roller 24 are replaced, as necessary. When the head cap 21 is replaced, the numerical values accumulated in the memories are reset, and are counted again according to the operating state of the ink-jet printer 11. The reset operation may be performed when a reset button is pressed by the user, or may be automatically performed when the head-cap attach sensor 57 (shown in FIG. 6) provided in the ink-jet printer 11 detects that the head cap 21 is replaced.

Figure 11:
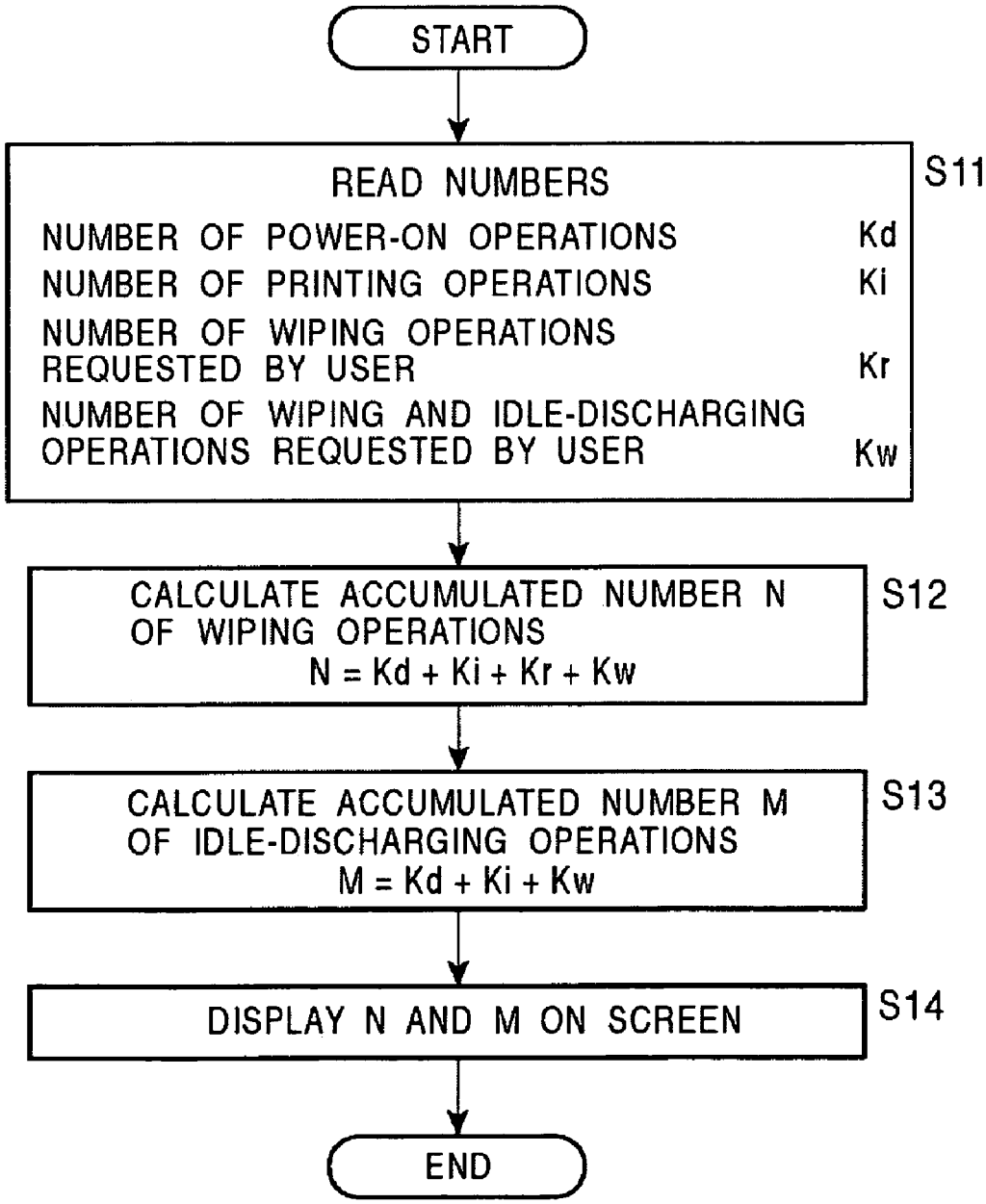
FIG. 11 is a flowchart showing another example of an operation of displaying the work volume of the cleaning roller and the work volume of the waste-liquid receiver when the cleaning operation is performed in the ink-jet printer.

FIG. 11 is a flowchart showing another example of a procedure for displaying the work volume of the cleaning roller 24 and the work volume of the waste-ink receiver 25 during a cleaning operation in the ink-jet printer 11.

In this example, when a command signal to clean the nozzle surface 22 shown in FIG. 2 is input to the main assembly 12, first, various numeric values concerning the cleaning operation for the nozzle surface 22 are read (Step S11). That is, the number Kr of power-on operations of the ink-jet printer 11, the number Ki of printing operations, the number of wiping operations performed by the cleaning roller 24 in response to the request from the user, and the number Kw of wiping and idle-discharging operations performed in response to the request from the user are read from the memories in the ink-jet printer 11.

Subsequently, the accumulated number N of wiping operations by the cleaning roller 24 is calculated (Step S12). The accumulated number N is given by the following expression using the above read values:

$$N=Kd+Ki+Kr+Kw$$

Then, the accumulated number M of idle-discharging operations by the waste-ink receiver 25 of the head cap 21 is calculated (Step S13). The accumulated number M is given by the following expression using the above read values:

$$M=Kd+Ki+Kw$$

Figure 9:
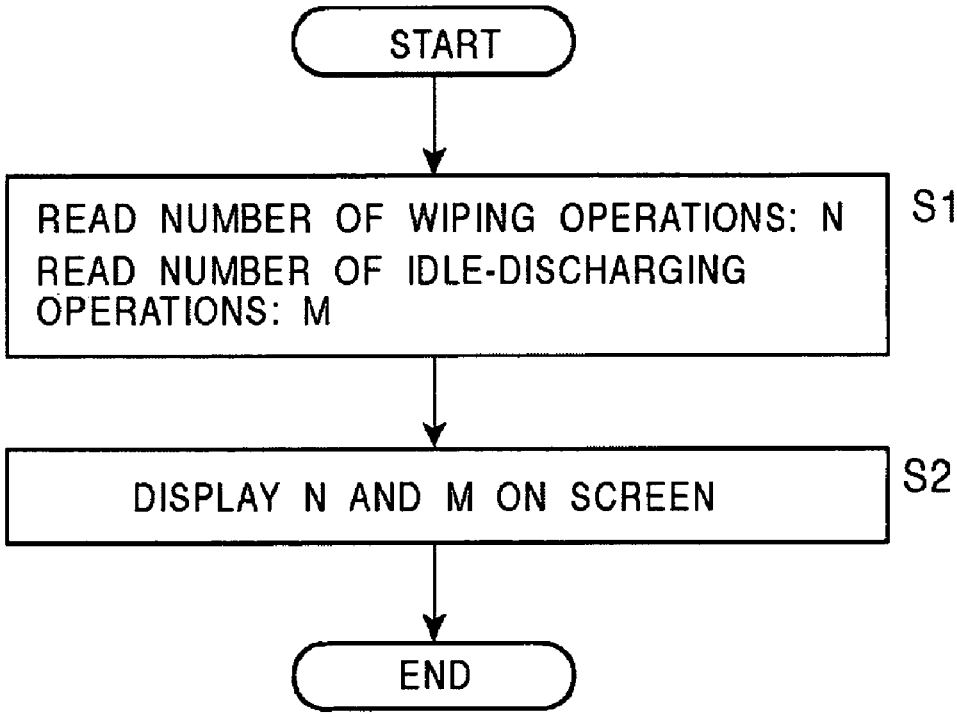
FIG. 9 is a flowchart showing an operation of displaying the work volume of a cleaning roller and the work volume of a waste-liquid receiver when the cleaning operation is performed in the ink-jet printer.

In a manner similar to that in Step S2 shown in FIG. 9, the number N of wiping operations and the number M of idle-discharging operations are displayed on the screen of the display panel 18 or on the screen of the display device of the host computer 38 (Step S14). In this case, both of or the higher one of the numbers N and M may be displayed.

In order to lighten the user's load when determining whether or not to carry out a cleaning operation for the nozzle surface of the print head 20, the CPU 34 shown in FIG. 6 may have therein a control unit that receives the work volume of the waste-ink receiver 25 (the number M of idle-discharging operations) and the work volume of the cleaning roller 24 (the number N of cleaning operations) from the idle-discharging-count storage unit 58 and the roller-wiping-count storage unit 59 and that stops a subsequent print operation when one of the numbers exceeds a predetermined upper limit. Since the print operation is automatically stopped in this case, it is possible to prevent the print quality from being reduced by the work volume higher than the upper limit.

While the present invention is applied to the ink-jet printer in the above-described embodiment, it is also applicable to any apparatus in which liquid stored in a liquid container is discharged in droplets from a liquid-discharging nozzle. For example, the present invention is applicable to image forming apparatuses such as facsimile apparatuses and copying machines using an ink-jet recording method.

The liquid discharged from the liquid-discharging nozzle is not limited to ink. The present invention is also applicable to any apparatus in which a predetermined liquid is discharged to form dot arrays and dots, for example, to a liquid-discharging apparatus for discharging a DNA solution onto a palette for DNA analysis.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid-discharging apparatus for forming a dot array or a dot by discharging liquid, comprising:

a main assembly;

a detachable liquid-discharging head provided in the main assembly to receive a predetermined liquid from a liquid container and to discharge the liquid through a plurality of liquid-discharging nozzles provided on a nozzle surface;

a detachable head cap mounted on the liquid-discharging head to move relative to the liquid-discharging head and to protect the nozzle surface, the head cap including a cleaning member for wiping the nozzle surface while moving, and a waste-liquid receiver for receiving waste liquid idly discharged from the liquid-discharging nozzles;

a first storage unit for storing the accumulated work volume of the cleaning member during a period from the beginning of use of the apparatus to the present time;

a second storage unit for storing the accumulated work volume of the waste-liquid receiver during the period; and an information output unit for receiving the work volumes from the first and second storage units and for outputting both of or the larger one of the work volumes.

2. A liquid-discharging apparatus for forming a dot array or a dot by discharging liquid, comprising:

a main assembly;

a detachable liquid-discharging head provided in the main assembly to receive a predetermined liquid from a liquid container and to discharge the liquid through a plurality of liquid-discharging nozzles provided on a nozzle surface;

a detachable head cap mounted on the liquid-discharging head to move relative to the liquid-discharging head and to protect the nozzle surface, the head cap including a cleaning member for wiping the nozzle surface while moving, and a waste-liquid receiver for receiving waste liquid idly discharged from the liquid-discharging nozzles;

a first storage unit for storing the accumulated work volume of the cleaning member during a period from the beginning of use of the apparatus to the present time;

a second storage unit for storing the accumulated work volume of the waste-liquid receiver during the period; and a display unit for receiving the work volumes from the first and second storage units and for displaying both of or the larger one of the work volumes.

3. A liquid-discharging apparatus according to claim 1 or 2, wherein the work volume of the cleaning member is given by the number of wiping operations performed by the cleaning member, the amount of the waste liquid absorbed by the cleaning member that is calculated from the number of wiping operations, the amount of the waste liquid absorbed by the cleaning member that is calculated by a predetermined equation from the number of wiping operations, or the ratio between the number of wiping operations and a predetermined upper limit of the number of wiping operations.

4. A liquid-discharging apparatus according to claim 1 or 2, wherein the work volume of the waste-liquid receiver is given by the number of idle-discharging operations of discharging the waste liquid from the liquid-discharging nozzles, the amount of the waste liquid absorbed by the waste-liquid receiver that is calculated from the number of idle-discharging operations, the amount of the waste liquid absorbed by the waste-liquid receiver that is calculated by a predetermined equation from the number of idle-discharging operations, or the ratio between the number of idle-discharging operations and a predetermined upper limit of the number of idle-discharging operations.

5. A liquid-discharging apparatus according to claim 1 or 2, wherein the work volume of the cleaning member is given by the number of wiping operations calculated by a predetermined expression from numeric values concerning the wiping operations.

6. A liquid-discharging apparatus according to claim 1 or 2, wherein the work volume of the waste-liquid receiver is given by the number of idle-discharging operations of discharging the waste ink from the liquid-discharging nozzles into the waste-liquid receiver, the number of idle-discharging operations being calculated by a predetermined expression from numeric values concerning the idle-discharging operations.

7. A liquid-discharging apparatus according to claim 1 or 2, further comprising:

a control unit that receives the work volumes from the first and second storage units and that stops a subsequent liquid-discharging operation when one of the work volumes exceeds a predetermined upper limit.

8. A liquid-discharging apparatus according to claim 1, wherein an output signal from the information output unit is sent to a display unit provided in the main assembly to display a driving state of the liquid-discharging apparatus.

9. A liquid-discharging apparatus according to claim 1, wherein an output signal from the information output unit is sent to a display device provided in an information processing apparatus connected to the main assembly, the display device displaying information processed by the information processing apparatus.

10. A liquid-discharging apparatus according to claim 8 or 9, wherein the output signal from the information output unit includes a signal for displaying the work volumes from the first and second storage units in the form of a numeral, a graph, or an image.

11. A liquid-discharging apparatus for forming a dot array or a dot by discharging liquid, comprising:

a main assembly;

a detachable liquid-discharging head provided in the main assembly to receive a predetermined liquid from a liquid container and to discharge the liquid through a plurality of liquid-discharging nozzles provided on a nozzle surface;

a cleaning member for wiping the nozzle surface;

a waste-liquid receiver for receiving waste liquid idly discharged from the liquid-discharging nozzles;

a first storage unit for storing the accumulated work volume of the cleaning member during a period from the beginning of use of the apparatus to the present time;

a second storage unit for storing the accumulated work volume of the waste-liquid receiver during the period; and an information output unit for outputting the work volumes stored in the first and second storage units to an external apparatus.

12. A liquid-discharging apparatus for forming a dot array or a dot by discharging liquid, comprising:

a main assembly;

a detachable liquid-discharging head provided in the main assembly to receive a predetermined liquid from a liquid container and to discharge the liquid through a plurality of liquid-discharging nozzles provided on a nozzle surface;

a cleaning member for wiping the nozzle surface;

a waste-liquid receiver for receiving waste liquid idly discharged from the liquid-discharging nozzles;

a first storage unit for storing the accumulated work volume of the cleaning member during a period from the beginning of use of the liquid-discharging apparatus to the present time;

a second storage unit for storing the accumulated work volume of the waste-liquid receiver during the period; and a display unit for displaying the work volumes stored in the first and second storage units.

* * * * *